US008487726B2

(12) United States Patent
Woods et al.

(10) Patent No.: US 8,487,726 B2
(45) Date of Patent: Jul. 16, 2013

(54) HIGH SECURITY SWITCH ASSEMBLY

(75) Inventors: Randall Woods, Sun Lakes, AZ (US); Joseph Hedeen, Oconomowoc, WI (US)

(73) Assignee: Magnasphere Corporation, Waukesha, WI (US)

( * ) Notice: Subject to any disclaimer, the term of this patent is extended or adjusted under 35 U.S.C. 154(b) by 0 days.

(21) Appl. No.: 13/019,769

(22) Filed: Feb. 2, 2011

(65) Prior Publication Data

US 2012/0194307 A1 Aug. 2, 2012

(51) Int. Cl.
*H01H 9/00* (2006.01)

(52) U.S. Cl.
USPC ..... 335/205

(58) Field of Classification Search
USPC ..... 335/205
See application file for complete search history.

(56) References Cited

U.S. PATENT DOCUMENTS

| | | | | |
|---|---|---|---|---|
| 4,170,005 | A * | 10/1979 | Duke | 340/547 |
| 4,210,889 | A * | 7/1980 | Holce | 335/207 |
| 5,233,323 | A * | 8/1993 | Burkett et al. | 335/207 |
| 5,332,992 | A | 7/1994 | Woods | |
| 5,633,626 | A | 5/1997 | Cawthorne | |
| 5,673,021 | A * | 9/1997 | Woods | 340/547 |
| 5,977,873 | A | 11/1999 | Woods | |
| 6,506,987 | B1 | 1/2003 | Woods | |
| 6,603,378 | B1 | 8/2003 | Collins | |
| 6,803,845 | B2 | 10/2004 | Woods | |
| 6,977,570 | B2 * | 12/2005 | Gilmore | 335/207 |
| 7,023,308 | B2 | 4/2006 | Woods | |
| 7,187,259 | B1 | 3/2007 | Habboosh | |
| 7,218,194 | B2 | 5/2007 | Habboosh | |
| RE39,731 | E * | 7/2007 | Woods | 340/547 |
| 7,248,136 | B2 * | 7/2007 | Habboosh | 335/205 |
| 7,259,647 | B2 * | 8/2007 | Gilmore | 335/205 |
| 7,291,794 | B2 * | 11/2007 | Woods | 200/61.62 |
| 7,518,478 | B2 * | 4/2009 | Habboosh | 335/205 |
| 7,944,334 | B2 * | 5/2011 | Woods | 335/205 |
| 2007/0035369 | A1 * | 2/2007 | Habboosh | 335/205 |
| 2007/0152784 | A1 * | 7/2007 | Habboosh | 335/205 |
| 2010/0006408 | A1 * | 1/2010 | Woods | 200/61.45 M |
| 2010/0008408 | A1 | 1/2010 | Spencer | |

FOREIGN PATENT DOCUMENTS

| | | |
|---|---|---|
| JP | 2007179919 | 7/2007 |
| JP | 2008210080 | 9/2008 |

OTHER PUBLICATIONS

International Search Report and Written Opinion, dated Sep. 28, 2012; PCT/US2012/022767, International Filing Date Jan. 26, 2012.

* cited by examiner

*Primary Examiner* — Alexander Talpalatski
(74) *Attorney, Agent, or Firm* — Hovey Williams LLP

(57) ABSTRACT

Tamper-resistant switch assemblies are provided including a first movement-sensing switch and a second tamper-sensing switch assembly, the latter including a switchable component and an actuating component. Preferably, the switch and switch assembly are housed within an encapsulated switch module, with the actuating component positioned above or to the side of the module. Mounting structure serves to support the module within a mounting opening and is operable to prevent removal of the switchable component and actuating component without significant relative shifting movement between the switchable component and actuating component. Any attempted tampering results in such relative shifting movement, thereby triggering an alarm.

7 Claims, 7 Drawing Sheets

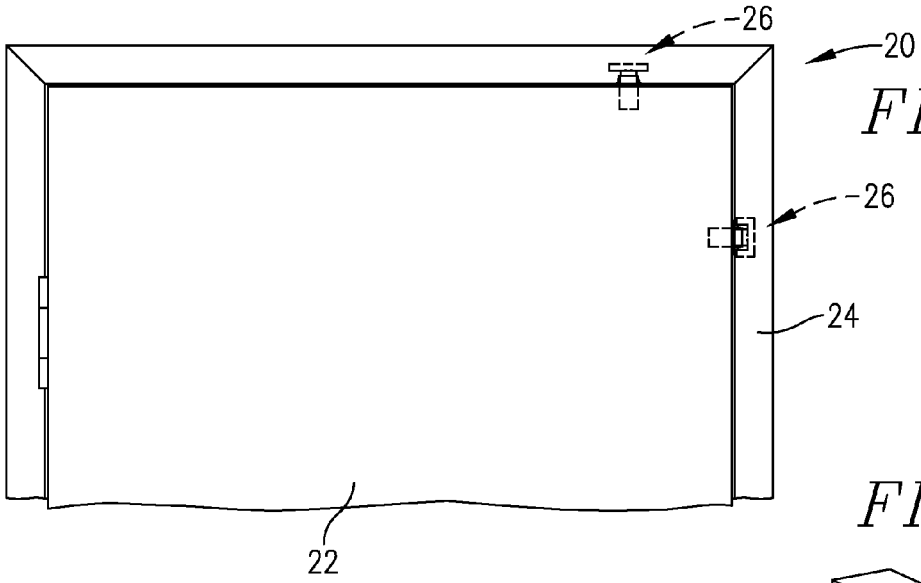
FIG. 1.
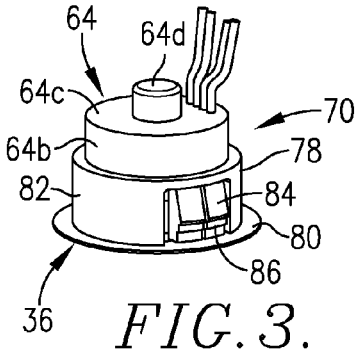
FIG. 3.
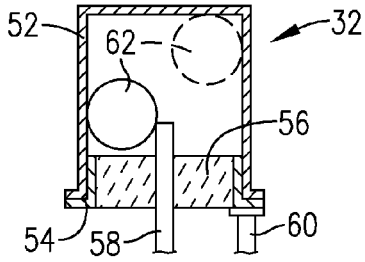
FIG. 3A.
FIG. 4.
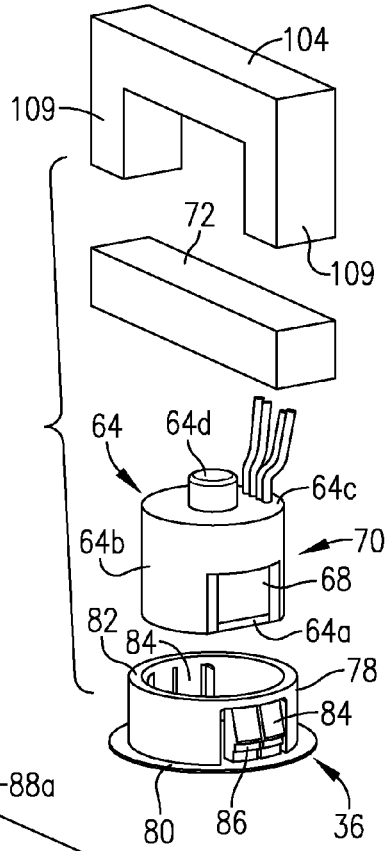
FIG. 2.
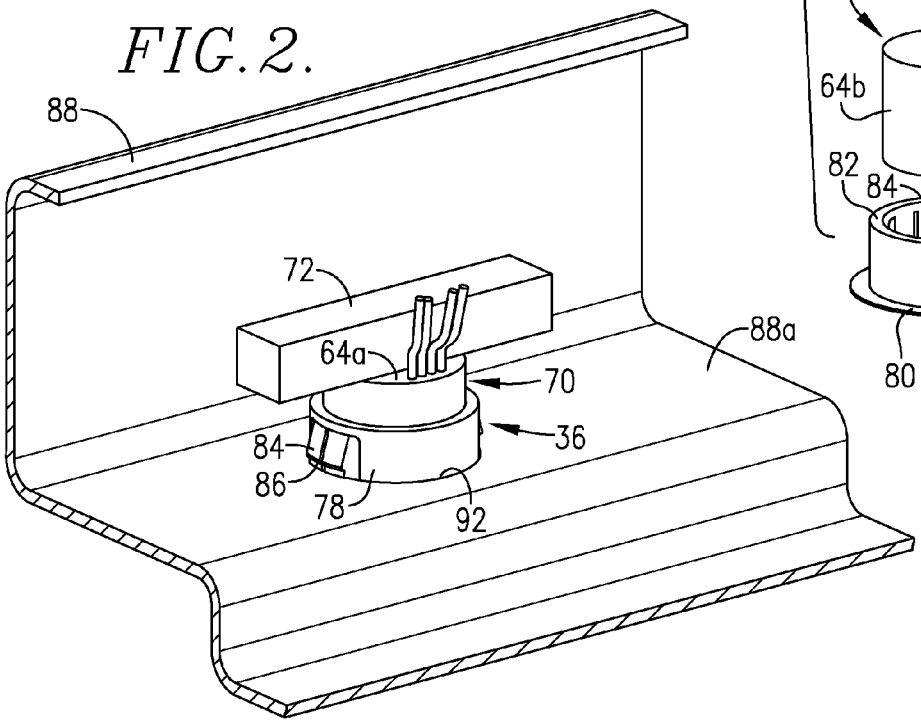

FIG. 5.
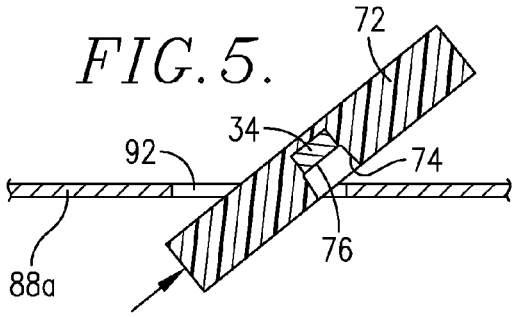
FIG. 3B.
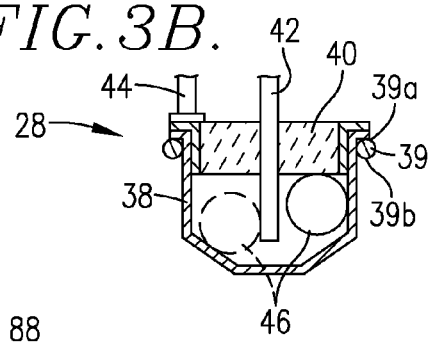
FIG. 6.
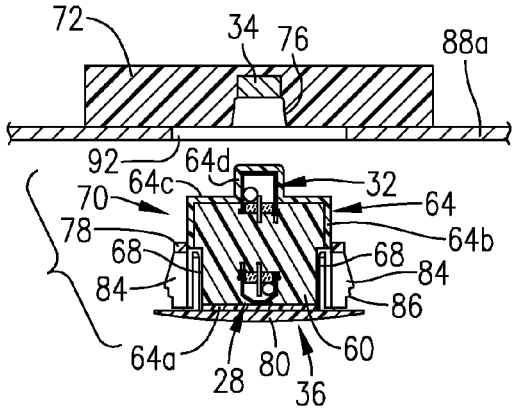
FIG. 9.
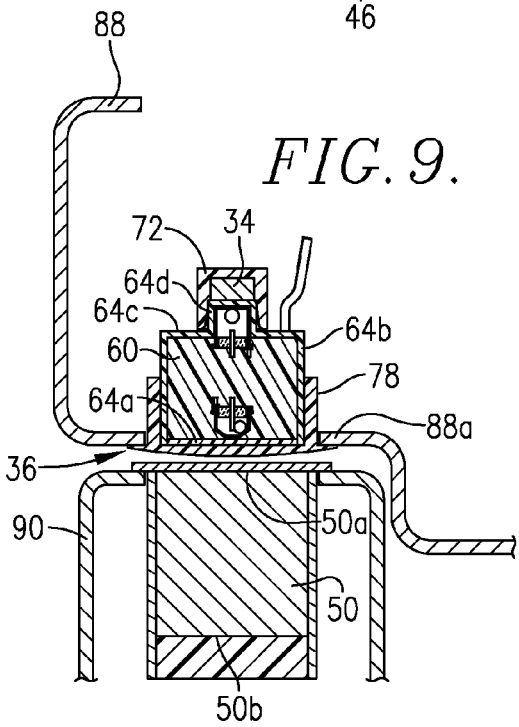
FIG. 7.
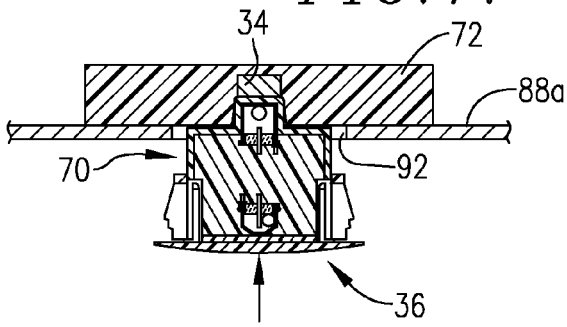
FIG. 8.
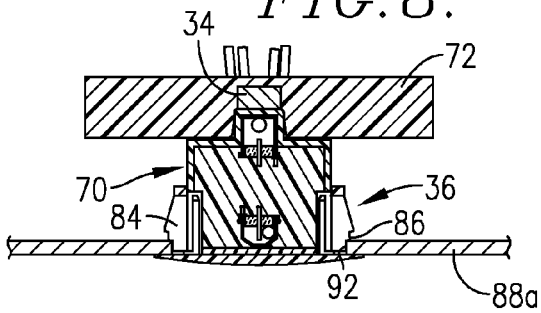
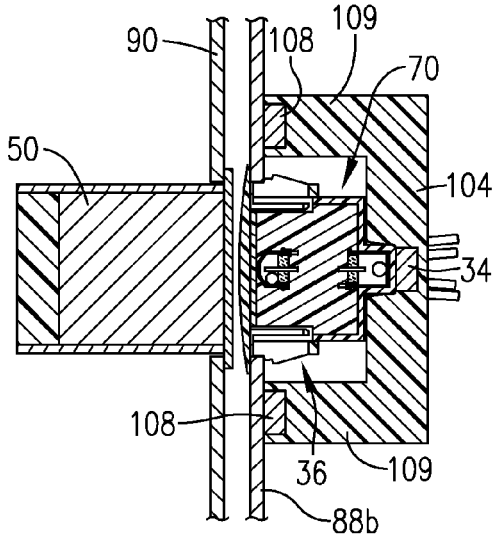
FIG. 10.

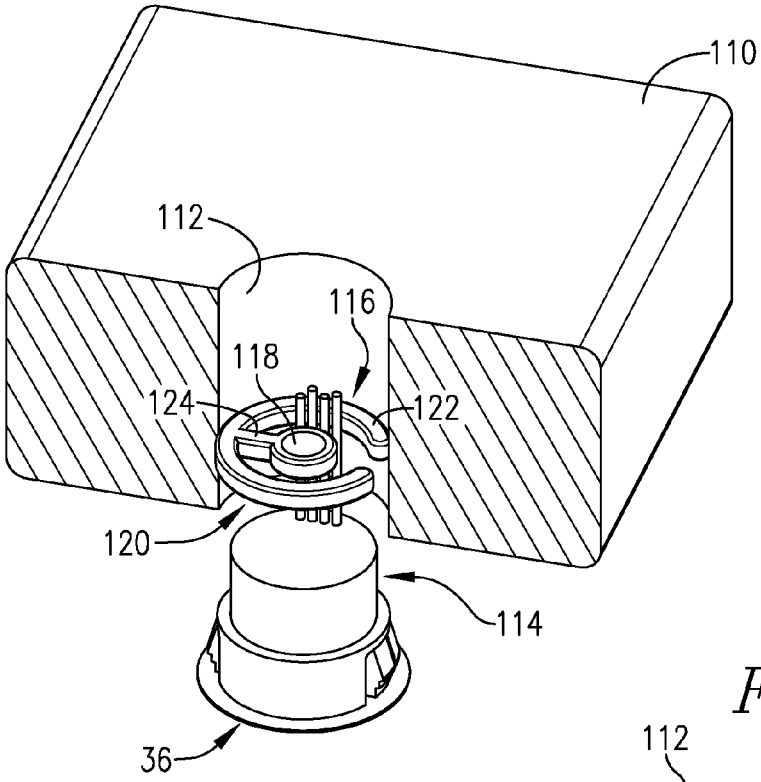
FIG. 11.
FIG. 13.
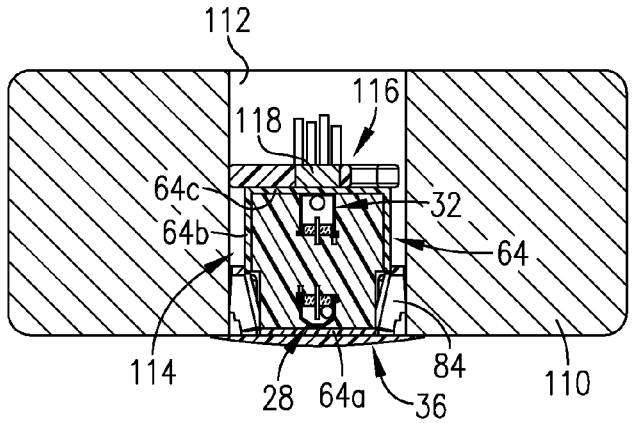
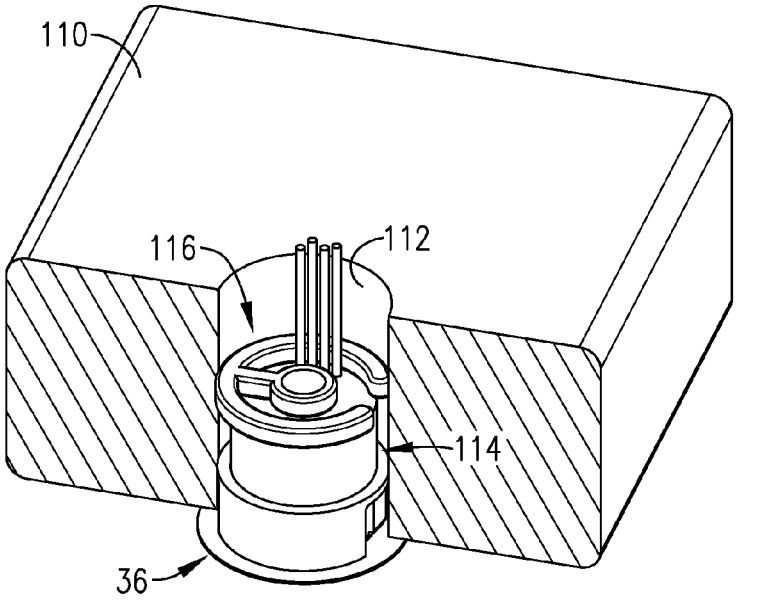
FIG. 12.

HIGH SECURITY SWITCH ASSEMBLY

BACKGROUND OF THE INVENTION

1. Field of the Invention

The present invention is broadly concerned with tamper-resistant switch assemblies for use in high-security contexts where it is not only necessary to detect relative movement between first and second members (e.g., a door and door frame), but also to detect any attempted tampering with the switch assemblies. More particularly, in one aspect the invention is concerned with tamper-resistant switch assemblies which include a tamper-sensing switch component and an actuating component which are relatively shiftable, as well as mounting structure operable to support the switch and actuating components and to prevent removal thereof without significant relative shifting movement which will trigger an alarm. In another aspect, the invention pertains to switch apparatus including a magnetic switch assembly which includes structure permitting fine adjustment of the position of the biasing magnetic component of the switch assembly relative to the opposed operating magnet; in this fashion, the switch apparatus may be tuned as necessary to prevent any defeat owing to use of a defeat magnet positioned between the switch apparatus and operating magnet.

2. Description of the Prior Art

In recent years the Magnasphere Corp. of Brookfield, Wisc. has introduced a series of innovative and highly reliable switch products useful as a part of alarm systems or as proximity sensors. Such Magnasphere switches in general include a hollow housing typically (though not necessarily) formed of electrically conductive material and with one or more conductive electrodes extending into the housing. A shiftable conductive ball is also located within the housing. The ball moves under the influence of magnetic conditions between respective switch states, usually from a position of simultaneous contact with the switch electrodes to a position out of such simultaneous contact. Such switches are referred to herein as "magnetic ball" switches. U.S. Pat. Nos. 7, 291,794; 5,977,873; 6,506,987; 6,603,378; 6,803,845; 7,023,308; and 5,332,992 illustrate various types of magnetic ball switches.

U.S. Pat. Nos. 7,187,259; 7,218,194; and 7,248,136 describe high security switch assemblies making use of magnetic ball switches. High security switches of this type are almost always mounted externally, e.g., external assemblies are mounted in adjacent relationship on a door and door frame. These external switches may also include anti-tamper switch components, see U.S. Pat. No. 5,633,626.

However, externally mounted, high security switches tend to be very unsightly and make easy access for potential tamperers. A particular problem in this regard is that putatively loyal employees may, during business hours or other time when an alarm system is not operational, attempt to tamper with switch components, so as to permit unauthorized entry during non-business hours when the alarm system is supposed to provide security.

Magnetic switch apparatus operable to detect movement of adjacent first and second members (e.g., a door frame and door) typically includes a magnet ball switch mounted on one of the members and an operating magnet mounted on the other. However, such switch apparatus may be subject to defeat if an intruder positions a magnet of sufficient strength in the region between the magnetic ball switch and operating magnet.

SUMMARY OF THE INVENTION

In one aspect of the invention, tamper-resistant switch assemblies in accordance with the invention are operable to detect relative movement between first and second members, with one of the members having an apertured outer surface and a hollow interior space inboard of the outer surface and in communication with the aperture. For example, the switch assemblies may be used to detect movement between a door and door frame, or between a window and sash.

The switch assemblies include a first movement-sensing switch located within the hollow interior space of one of the members inboard of the outer surface thereof and operable to switch between first and second separate movement-sensing switch states in response to relative movement between the first and second members. Additionally, the assemblies have a second tamper-sensing switch assembly also located within the hollow interior space of the one member inboard of the outer surface and including a switchable component and an actuating component. The switchable component and actuating component are relatively shiftable, with the switchable component switchable between first and second tamper-sensing states in response to significant relative shifting between the switchable and actuating components. Anti-tampering mounting structure is provided to support the first switch and second switch assembly within the hollow interior space of the one member and inboard of the outer surface thereof in a normal operating position, wherein the first switch will sense the relative movement between the first and second members. The anti-tampering mounting structure is furthermore operable to prevent removal of the switchable component and the actuating component without the alarm-triggering relative shifting between the switchable component and actuating component.

In preferred forms, the actuating component is located in close proximity (e.g., directly above or beside) the switchable component of the tamper-sensing switch assembly, and is supported so that any attempt to remove the switchable component will necessarily cause separation of the switchable component and the adjacent actuating component. For example, the actuating component may be supported on an elongated body which cannot be accessed without removal of the switchable component.

Both the movement-sensing switch and switchable component of the tamper-sensing switch assembly are advantageously in the form of magnetic ball switches, which are operable to change switch states depending upon ambient magnetic conditions. To this end, the movement-sensing switch is preferably provided with a switch-mounted magnetic biasing element, and a larger magnet mounted in the other member. In normal operation, the larger magnet magnetically moves the switch ball to an initial state; in the event of relative movement between the first and second members, the larger magnet is separated from the movement-sensing switch, whereupon the magnetic biasing element serves to move the ball to another switch state. This change in switch state is detected by alarm circuitry and an alarm is triggered. Likewise, the tamper-sensing switch component cooperates with the actuating component such that in normal use, the actuating component magnet maintains the ball in an initial switch state. In the event of tampering, the switchable and actuating component are separated and the switch ball moves to another switch state to trigger an alarm.

In another aspect of the invention, conventional switch apparatus for detecting movement between first and second members and having a magnetic ball switch mounted on one of the members and an operating magnet on the other of the members is improved by the provision of structure permitting fine adjustment of the position of the first magnetic component forming a part of the switch. Preferably, the switch is encapsulated within a synthetic resin matrix, and the first magnetic component is operatively coupled with a rotatable screw allowing shifting adjustment of the first magnetic component toward and away from the switch ball and the operating magnet.

BRIEF DESCRIPTION OF THE DRAWINGS

FIG. 1 is a fragmentary view of a door and door frame, illustrating a tamper-resistant alarm switch in accordance with the invention in alternate positions along the top and side of the door/door frame;

FIG. 2 is an enlarged, fragmentary view depicting an alarm switch module and actuating component forming a part of the alarm switch of the invention and mounted in a standard metal door frame using a hole plug;

FIG. 3 is a perspective view of a switch module and hole plug assembly forming a part of the alarm switch illustrated in FIG. 2;

FIG. 3A is an enlarged, schematic vertical sectional view of the preferred anti-tampering switch component used in the present invention;

FIG. 3B is an enlarged, schematic vertical sectional view of the preferred movement-sensing switch used in the present invention;

FIG. 4 is an exploded view of the hole plug, alarm switch module, and actuating component, illustrating alternate actuating components;

FIG. 5 is a fragmentary vertical sectional view illustrating the first step in the installation of an alarm switch in accordance with the invention on a standard metal door frame, wherein the elongated actuating component is passed through a door frame aperture;

FIG. 6 is a fragmentary vertical sectional view of the second step of the alarm switch installation, illustrating the elongated actuating component positioned within the door frame and with the switch module and hole plug assembly ready for installation;

FIG. 7 is a fragmentary vertical sectional view of the third step of the alarm switch installation, wherein the switch module and hole plug assembly is being installed through the door frame aperture;

FIG. 8 is a fragmentary vertical sectional view of the fully installed switch module and hole plug assembly, with the elongated actuating component operatively surmounting the switch module;

FIG. 9 is a fragmentary vertical sectional view of the entire alarm switch assembly, viewing the components installed in the door frame and door;

FIG. 10 is a fragmentary vertical sectional view of an alternate fully installed alarm switch assembly wherein respective components thereof are mounted in the side of a door and in the side of the door frame;

FIG. 11 is a fragmentary perspective view of the installation of another embodiment of an actuating component in an apertured wood door frame, and with the associated hole plug and switch module assembly ready for installation below the actuating component;

FIG. 12 is a fragmentary perspective view illustrating the complete installation of the hole plug and switch module assembly, with the corresponding actuating component operatively disposed above the switch module;

FIG. 13 is a vertical sectional view of the installed hole plug and switch module assembly with the surmounting actuating component seen in FIG. 12;

DETAILED DESCRIPTION OF THE PREFERRED EMBODIMENT

Figure 15:
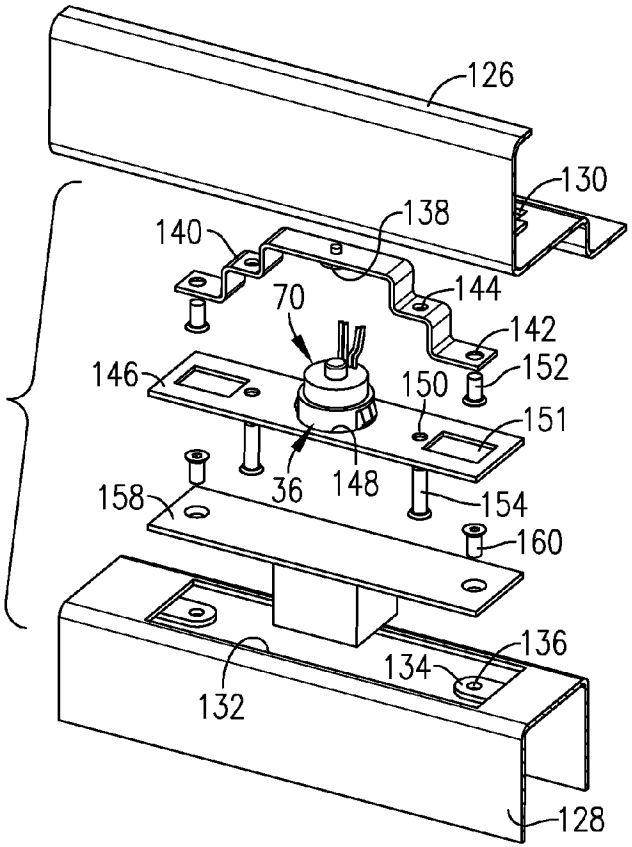
FIG. 15 is a fragmentary exploded view similar to that of FIG. 14, but illustrating a top view thereof.
Figure 16:
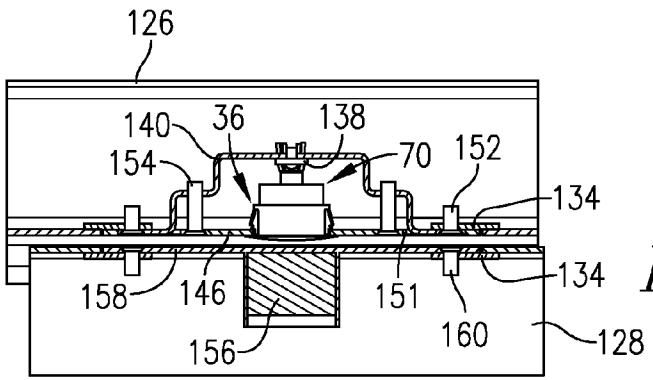
FIG. 16 is a vertical sectional view of all of the components of the switch assembly, mounted in the door frame and door.
Figure 14:
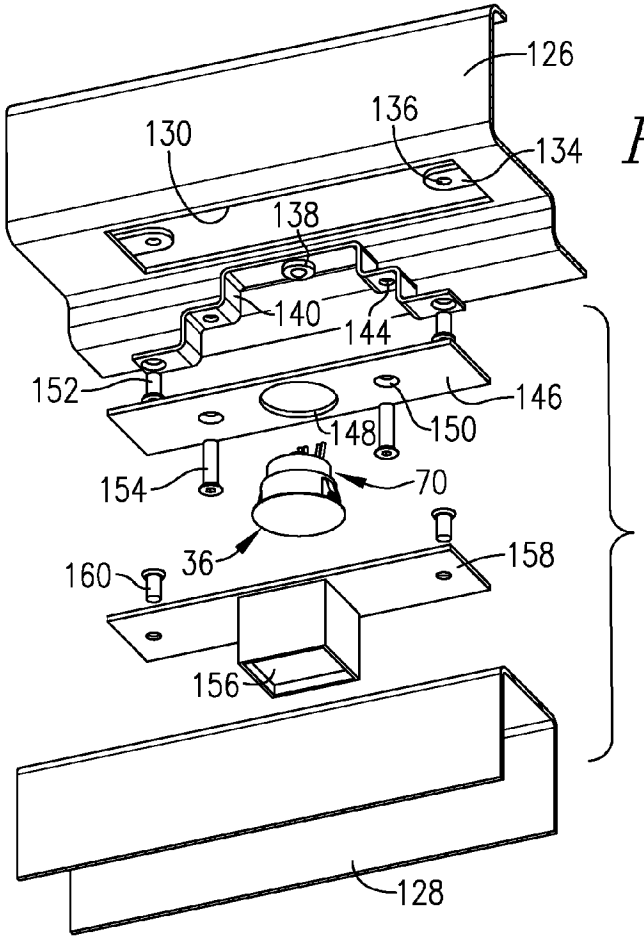
FIG. 14 is a bottom fragmentary exploded view of the components of another alarm switch in accordance with the invention, designed for installation in ANSI cutouts provided in a metal door and door frame.
Figure 17:
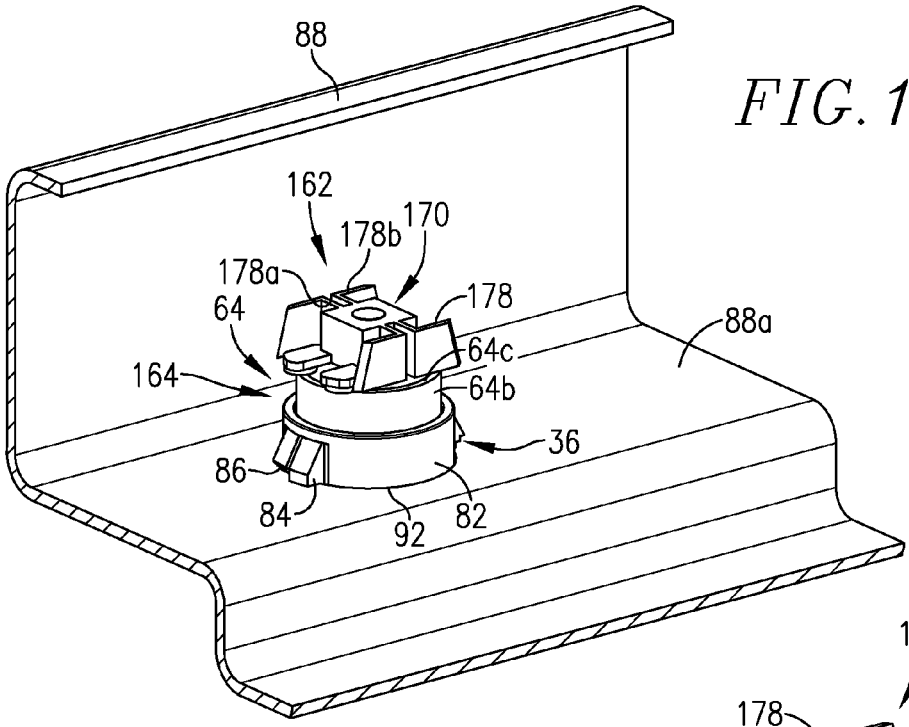
FIG. 17 is an enlarged, fragmentary view similar to that of FIG. 2, but illustrating another type of alarm switch module and actuating component in accordance with the invention.
Figure 18:
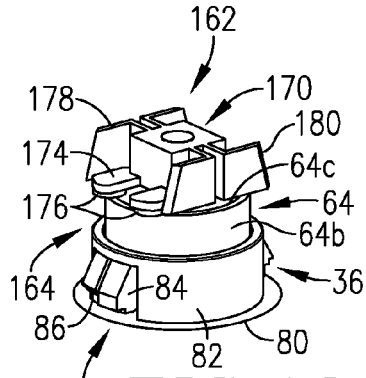
FIG. 18 is a perspective view of the switch module and hole plug assembly forming a part of the alarm switch of FIG. 17.
Figure 20:
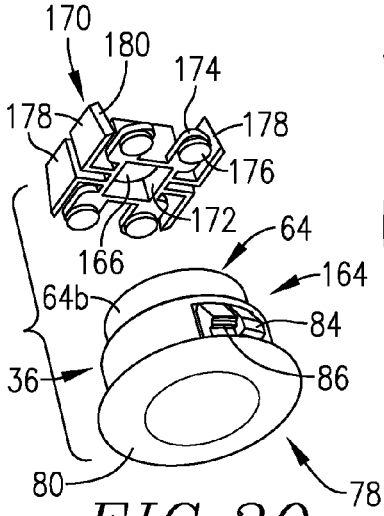
FIG. 20 is a bottom perspective view of the module illustrated in FIG. 17, depicting the actuating component separated from the alarm switch module.

Turning now to the drawings, a protected door and door frame assembly 20 is depicted in FIG. 1 and includes a conventional door 22 and surrounding door frame 24. The assembly 20 is protected by a tamper-resistant alarm switch assembly 26, which can be mounted in the alternate top and side positions depicted in the figure. Although not shown, it will be understood that the switch assembly 26 is operably coupled with an alarm controller and alarm bell or other perceptible alarm-indicating device. A complete system of this type is illustrated in U.S. Pat. No. 7,291,794 (FIG. 3), and such system disclosure is incorporated by reference herein.

The tamper-resistant switch assemblies of the invention are similar to the switch assemblies illustrated and described in U.S. Patent Publication No. US-2010-0006408, which is incorporated by reference herein in its entirety.

The alarm switch assembly 26 includes a first movement-sensing switch 28 (FIG. 3B) and a second tamper-sensing switch assembly 30, the latter including a switchable component in the form of a switch 32 (FIG. 3A) and an actuating component 34. Anti-tampering mounting structure 36 is provided for securing the switch 28 and switch assembly 30 within one of the door 22 or door frame 24 of assembly 20. Preferably, the switch 28 and switch assembly 30 are mounted on the door frame 24, such that the operative components are internally located in a hollow interior space within the confines of the door frame. Other components of the overall assembly 26 are mounted on door 22, as will be explained. In use, the alarm assembly 26 is designed to initiate an alarm in the event of an unauthorized opening of door 22 when the alarm system is armed. Moreover, the assembly 26 is especially designed to provide a secure and reliable anti-tamper function when the door 22 is properly opened, for example during normal business hours when the movement-sensing switch 28 is disarmed, thus potentially exposing the alarm switch assembly 26 to tampering.

In greater detail, the preferred movement-sensing switch 28 is a magnetic ball switch of the type commercialized by Magnasphere, Inc. of Brookfield, Wisc. Such an exemplary switch is illustrated in FIG. 3B and includes a metallic can-like housing 38. The open end of housing 38 is equipped with a circumscribing magnetic biasing ring 39 and is closed by a metal-encased dielectric glass plug seal 40. An elongated, electrically conductive electrode 42 extends through and is supported by plug seal 40 as shown, into the confines of housing 38. A second electrode 44 is electrically coupled with metallic housing 38. The switch 28 further includes a shiftable ball 46 located within housing 38. Preferably, the ball is formed of a magnetic material, such as a ferromagnetic metal, or comprises a nonmetallic ball coated with such a biasing material.

As further shown in FIG. 3B, the ball 46 may assume a first position (shown in full lines), corresponding to a first switch state, wherein the ball 46 is magnetically biased under the influence of ring 39 toward the plug seal 40 and is thereby out of simultaneous electrical contact with both the first and second electrodes 42, 44; the ball 46 may alternately assume a second position (shown in phantom) corresponding to a second switch state, wherein the ball 46 is in simultaneous electrical contact with the electrodes 42, 44. The overall switch 26 further includes an operating magnet 50, which in the illustrated embodiment is mounted within the door 22.

It will be appreciated that when the door 22 is closed, operating magnet 50 is closely adjacent the switch 28. As such, the magnetic field conditions adjacent the switch 28, created and induced by magnet 50, overcome the magnetic bias of ring 39 and serve to move ball 46 to the second position described above, where the ball is in simultaneous electrical contact with the electrodes 42 and 44.

The preferred tamper-sensing switch component 32 is likewise of the magnetic ball variety (FIG. 3A). Specifically, the switch component 32 includes a metallic housing 52 and a top made up of peripheral wall 54 and central non-conductive glass plug seal 56. A first electrode 58 is supported by and extends through plug seal 56 and into the confines of housing 52. A second electrode 60 is secured to conductive housing 52. A shiftable ball 62 is located within housing 52 and is shiftable between a first position corresponding to a first switch state, wherein the ball 62 is in simultaneous electrical contact with the electrodes 58 and 60. The ball 62 may, under the influence of gravity, assume this first position; alternately, a magnetic biasing ring (not shown) may be disposed about the lower end of housing 52 to magnetically shift the ball 62 into the first position. In the event that the switch component 32 experiences magnetic field conditions of significant magnitude, the ball 62 is magnetically shifted to a second position corresponding to a second switch state out of simultaneous contact with electrodes 58, 60, as shown in phantom in FIG. 3A.

In this embodiment, the movement-sensing switch 28 and the switch component 32 are encased within an outer housing 64, having bottom wall 64*a*, tubular sidewall 64*b*, top wall 64*c*, and a central, upwardly extending protrusion 64*d*. The housing 64 is filled with a synthetic resin encapsulant 66 engaging the switch 28 and switch component 32. As best seen in FIG. 4, the sidewall 64*b* has a pair of opposed, relieved regions 68, which are important for reasons to be made clear. The switch 28 is positioned centrally within housing 64 and adjacent bottom wall 64*a* thereof, whereas the switch component 32 is centrally located adjacent top wall 64*c* and within the protrusion 64*d*. In this fashion, the outer housing 64 and the internal components thereof define an alarm switch module generally referred to by the numeral 70.

The actuating component 34 in the embodiment of FIGS. 1-8 is supported by an elongated body 72 presenting a tapered, central, lower opening 74, which receives the protrusion 64*d* housing the switch component 32. The actuating component 34 is preferably in the form of a magnet having a flat lower surface 76. The body 72 and actuating component 34 are thus adapted to surmount the module 70, with the protruding switch component 32 extending into the opening 74, such that the flattened upper surface of protrusion 64*d* abuts the lower surface 76 of the actuating component magnet.

The mounting structure 36 in this embodiment is a standard hole plug 78 having a base 80, and an upwardly extending, tubular, apertured sidewall 82. The sidewall 82 supports two opposed pairs of depending, resilient locking fingers 84, each equipped with an outwardly extending locking projection 86. As best seen in FIG. 4, the module 70 is designed to snugly fit within sidewall 82, with the recesses 68 thereof in alignment with the opposed pairs of locking fingers 84.

This embodiment of the invention is specifically designed for use with a standard metal door frame 88 and door 90, both of which are hollow. The upper horizontally extending portion of frame 88 presents a generally flat central section 88*a*, whereas the vertical sections thereof present opposing inner panels 88*b*.

The stepwise installation of the alarm switch assembly 26 is illustrated in FIGS. 5-9. In the first step, a hole 92 is bored through the door frame central section 88*a*, as indicated. The hole 92 is sized to properly accommodate the hole plug 78. For example, the depicted hole 92 has a diameter of one inch, and is thereby designed to receive a commercially available hole plug (hEyco Model #2716).

In the next step (FIG. 5), the body 72 is passed through door frame opening 92 and is centrally located across the opening 92, as illustrated in FIG. 6. Next, the module 70, with the surrounding hole plug 78, is inserted into opening 92 and pushed upwardly until the protrusion 64*d* is seated within opening 74. Continued upward movement of the module 70 and hole plug 78 results in elevation of the body 72 and full insertion of the plug 78 into the opening 92 (FIG. 8). As illustrated, the locking projections 86 of the fingers 84 move outwardly to engage the upper surface of the frame 88 adjacent opening 92. This serves to lock the module 70 and body 72 in place.

The final step in the installation is the formation of a hole 94 in the top wall of door 90, in a location such that the openings 92 and 94 will be in substantial registry when door 90 is closed. The actuation magnet 50 is supported by a mount 96 having an upper plate 98 and a depending, tubular extension 100. In order to affix the mount 96 in place, a pair of threaded fasteners (not shown) are passed through the plate 98 and into the top wall of door 90. As illustrated, the magnet 50 is quite large and is maintained within extension 100 by means of a lower synthetic resin plug 102.

FIG. 9 illustrates the door 90 closed against the door frame 88 in the normal security position of the switch assembly 26. As seen, the magnet 50 is directly below the movement-sensing switch 28, and the influence of the magnet 50 serves to move switch ball 46 against the bias of ring 39 to the lower position thereof corresponding to the second switch condition. At the same time, the presence of the magnetic actuating component 34 above the switching component 32 causes the switch ball 62 to assume the position illustrated, corresponding to the second switch state thereof.

If the door 90 is opened without disarming the alarm system, the movement of magnet 50 away from movement-sensing switch 28 allows the biasing magnet ring 39 to magnetically move ball 46 to its first switch position. The change in switch state is then read by the alarm system and an alarm is triggered. It will be appreciated that during this operational sequence, the tamper switch component 32 does not come into play.

However, in high security situations, a tamper-resistant switch is desirable in order to prevent tampering when the switch assembly 26 when the door 90 is opened during normal business hours or the like. In the present invention, though, such tampering will be readily detected. That is to say, in order to prevent the sounding of an alarm, both the module 70 and the actuating component 34 must be removed from door frame 88 without causing significant relative movement between the module and actuating component. It will be appreciated that any significant separation of these components will cause ball 62 of switch component 32 to move to the first switch state thereof, because of the absence of the actuating component 34 causing body 62 to move under the influence of gravity and/or be magnetically moved if a biasing member forms a part of the switch component 32. In any event, such triggers an alarm. However, owing to the length of body 72, it is impossible to remove module 70 without effecting the alarm-triggering separation of the switch component 32 and actuating component 34. Preferably, the body 72 has a length substantially greater than the diameter or largest dimension of the opening 92, e.g., the body 72 should have a length preferably at least about 1.5 times greater than that of the opening 92.

FIG. 10 illustrates an alternate embodiment wherein the switch assembly 26 is mounted in a panel 88*b* of the frame 88, rather in the section 88*a* thereof. In this instance, all of the components are identical to the first-described embodiment, save for the configuration of the body supporting the magnetic actuating component 34. Specifically, the component 34 is supported by a substantially C-shaped body 104 having a tapered opening 106 formed centrally in the bight of the body 104. Additionally, a locating magnet 108 is provided at the bottom of each of the legs 109 of the body 104. The magnets 108 are designed to engage the inner surface of metallic panel 88*b* and magnetically assist in maintaining the position of the body 104 against the panel. The operation of the FIG. 10 embodiment is identical to that of the embodiment of FIGS. 1-9, and thus need not be repeated.

FIGS. 11-13 illustrate a further embodiment of the invention, designed for use with a wooden door frame 110. In this instance, the door frame 110 is provided with a bore 112 of appropriate dimension, which houses a switch module 114 as well as an actuating component 116. As best illustrated in FIG. 13, the module 114 is very similar to module 70, and accordingly like reference numerals will be used to describe the module 114. In particular, the housing 64 has bottom wall 64*a*, sidewall 64*b*, and a substantially flat top wall 64*c*. The switch 28 and switch component 32 are centrally located within housing 64 respectively adjacent the top and bottom walls 64*a*, 64*c* thereof. The module 114 is seated within hole plug 36, as illustrated. The actuating component 116 includes a central biasing magnet 118, supported by a resilient, substantially C-shaped retainer body 120 having an outer arcuate section 122 engaging the walls of bore 112, and an inwardly extending leg section 124 supporting the magnet 118.

The installation of this embodiment will be readily understood from consideration of FIGS. 11-13. First, the actuating component 116 is seated within bore 112, whereupon the switch module 114 and hole plug 36 are inserted into the bore 112 and are frictionally locked in place by means of the inter-engagement of the fingers 84 and the defining surface of bore 112. In this orientation, the actuating component 32 is directly below the magnet 118. Of course, a large biasing magnet would also be installed in the door (not shown), just as in the first-described embodiment.

The operation of this embodiment, both for movement and tamper sensing, is exactly as described in connection with the embodiment of FIGS. 1-8. In each instance, movement of the door or attempted tampering with the switch assembly will cause a change in switch state and triggering of an alarm. It will further be appreciated that the switch assembly and biasing magnet may be installed in the side of the door frame and door, consistent with the illustration of FIG. 10.

FIGS. 14-16 and 25 depict a still further embodiment in accordance with the invention, wherein a hollow metal door frame 126 and door 128 are equipped with standard ANSI openings 130 and 132. Each ANSI opening is substantially rectangular and has a pair of inwardly extending connection ears 134 provided with a threaded bore 136.

In this embodiment, the module 114 and hole plug 36 are utilized along with an actuating biasing magnet 138. A stepped metallic bracket 140 supports the magnet 138 as shown, and has first and second sets of bores 142, 144. A mounting plate 146 having a central opening 148 is also provided, having a set of bores 150 located for alignment with the bores 144 of bracket 140. The mounting plate 146 also has a pair of relieved zones 151 on the inner face thereof and on opposite sides of opening 148 outboard of the bores 150.

The installation of module 114 proceeds as follow. First, the bracket 144 is passed through opening 130 until the outboard openings 142 come into registry with the ear bores 136. At this point, screws 152 are used to secure the bracket 144 to the mounting ears 134. In the next step, the mounting plate 146 is secured to bracket 140 by means of screws 154, which are passed through the bores 150 and threaded into the bores 144, with the zones 151 accommodating the heads of screws 152. Next, the module 114 and hole plug 36 are inserted into opening 148 and are pressed upwardly until the hole plug is fully seated within the opening 148 and frictionally retained by means of the locking fingers 84.

The overall switch assembly further includes a door-mounted biasing magnet 156, which is supported by an elongated, apertured mounting plate 158. As shown, the plate 158 is secured to the ears 134 of door 128 by means of screws 160, so that the depending magnet 156 is correctly positioned relative module 114.

Again, the operation of this embodiment in terms of both movement and tamper sensing is identical to that of the first and second embodiments and thus need not be repeated. FIGS. 17-22 depict a still further alarm switch assembly 162 broadly including a switch module 164 supported by a hole plug 78, both previously described; therefore, like reference numerals are used to identify identical parts. The module 164 includes an encapsulant-filled housing 64 containing a movement-sensing switch and a tamper-sensing switch, similar to the switches 28 and 32. However, the movement-sensing switch of this embodiment differs from switch 28 in that it is provided with a flat magnetic biasing plate atop the dielectric glass plug seal 40 of the housing, in lieu of the biasing ring 39.

In all other details, the movement-sensing switch and the tamper-sensing switch are identical to the switches 28 and 32.

Figure 21:
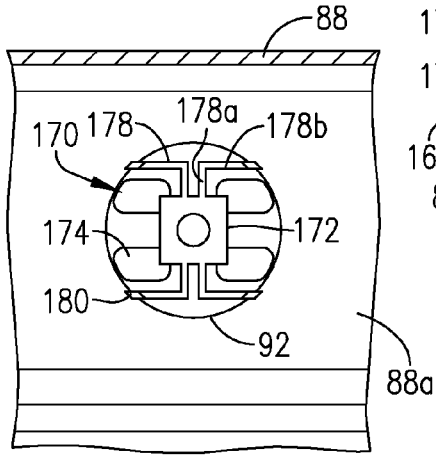
FIG. 21 is a top view of the orientation of the actuating component of the embodiment of FIGS. 17-20, after separation of the actuating component from the alarm switch module.
Figure 19:
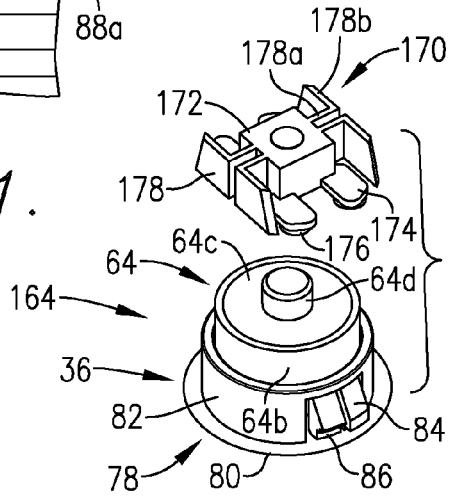
FIG. 19 is an exploded, top perspective view of the module illustrated in FIG. 17, depicting the actuating component separated from the alarm switch module.
Figure 22:
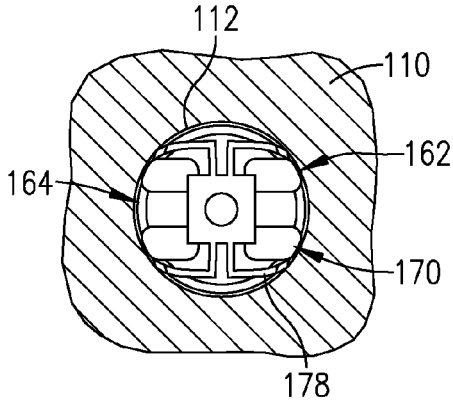
FIG. 22 is a top view of the alarm switch module and actuating component mounted in a wooden door frame.

In this instance, the magnetic actuating component 34 is in the form of a magnet 166, and is supported within a body 170. The body 170 is formed of yieldable synthetic resin material (preferably ABS) and includes a central, recessed, square section 172 designed to hold the magnetic component 166. An outwardly extending mounting arm 174 is secured to each corner of the section 172 and each arm 174 is equipped with an outer adhesive pad 176 (preferably silicone adhesive) on the underside thereof. Four generally L-shaped legs 178 are also attached to section 172 between the opposed pairs of arms 174; each of the legs 178 has a pair of perpendicular sections 178*a*, 178*b*. It will be observed that the legs 178 are arranged in opposed pairs, and that the leg sections 178*a* are slightly spaced apart (FIG. 21). The outboard end of each leg section 178*b* is provided with an angularly oriented beveled surface 180.

The switch assembly 162 is constructed by positioning the recessed square section 172 over the protrusion 64*d* and pressing the adhesive pads 176 into contact with top wall 64*c*, so as to insure that the magnetic component 166 is directly atop the protrusion 64*d*. This in turn assures that the magnetic ball of the tamper-sensing switch within housing 64 assumes the position illustrated in FIG. 7. The assembly 162 may then be installed in opening 92 of door frame section 88*a* by pressing the assembly upwardly through the opening 92. The beveled surfaces 180 of the leg sections 178*b* cause the leg sections 178*a* and 178*b* to flex inwardly so that the sections 178*a* assume a position closer together. This allows the body 170 carrying component 166 to clear the opening 92 until the legs 178 are moved above the inner surface of the section 88*a*. The legs 178 then flex outwardly, as shown in FIG. 21, thereby preventing removal of the assembly 162 without detachment of the body 170 and component 166 from the switch module 164. This in turn serves to initiate an alarm in the manner previously described. Of course, the movement-sensing switch of the module 164 operates as previously described.

In the case of a wooden doorframe 110 having opening 112 therein, the assembly 162 is installed by pressing the assembly upwardly into the opening. Again, the beveled surfaces 180 of the body leg sections 178*b* engage the wall surface defining the opening 112, causing the leg sections 178*a* and 178*b* to flex inwardly. However, owing to the resilient nature of the legs 178, the entire assembly is maintained within opening 112 by the frictional contact between surfaces 180 and the defining surface of opening 112. In like manner, removal of the assembly 162 cannot be accomplished without detachment of the component 166 from the switch module 164, again triggering an alarm.

In all of these embodiments, it is preferred to arrange the door magnet and the biasing magnet associated with the movement-sensing switch in a special way. Referring for example to the embodiment of FIGS. 1-8, it will be observed that the door magnet 50 presents a pair of opposed inner and outer faces 50*a* and 50*b*. As such, one of these faces will have a magnetic North polarity, while the other face will have a magnetic South polarity. Likewise, the adjacent magnetic biasing ring 39 forming a part of switch 28 will have an upper surface 39*a* and a lower surface 39*b*, again with corresponding North and South polarities. It is desirable in the present invention to arrange the magnets 50 and 39 so that the adjacent polarities are the same, thereby causing a magnetic repulsion between them. For example, the magnet 50 should be arranged so that the face 50*a* is of North polarity, while the underside 39*b* of magnetic biasing ring 39 is likewise of North polarity. An identical situation would be where the magnet 50 and ring 39 are arranged with adjacent South polarities.

This arrangement is deemed preferable for the following reasons. If the magnets were arranged with opposite polarities, the two magnets would attract. In this instance, if the door 22 is opened while the alarm switch assembly 26 is armed, there could be a short distance during such opening where the magnetic conditions affecting ball 46 of movement-sensing switch 28 remain unchanged. In such a case, it would theoretically be possible to insert a powerful defeat magnet between the door 22 and door frame 24 at the region of the door magnet 50. In this fashion, it could be possible to continue opening door 22 without triggering an alarm, i.e., the defeat magnet would maintain ball 46 in its lowered position, as viewed in FIG. 9.

However, if a like-polarity, magnetic repulsion condition is established between the proximal faces of the magnets 50 and 39, the distance door 22 could be moved without triggering alarm is significantly reduced or entirely eliminated. This in turn makes it much more difficult to employ a defeat magnet, as previously described.

Figure 23:
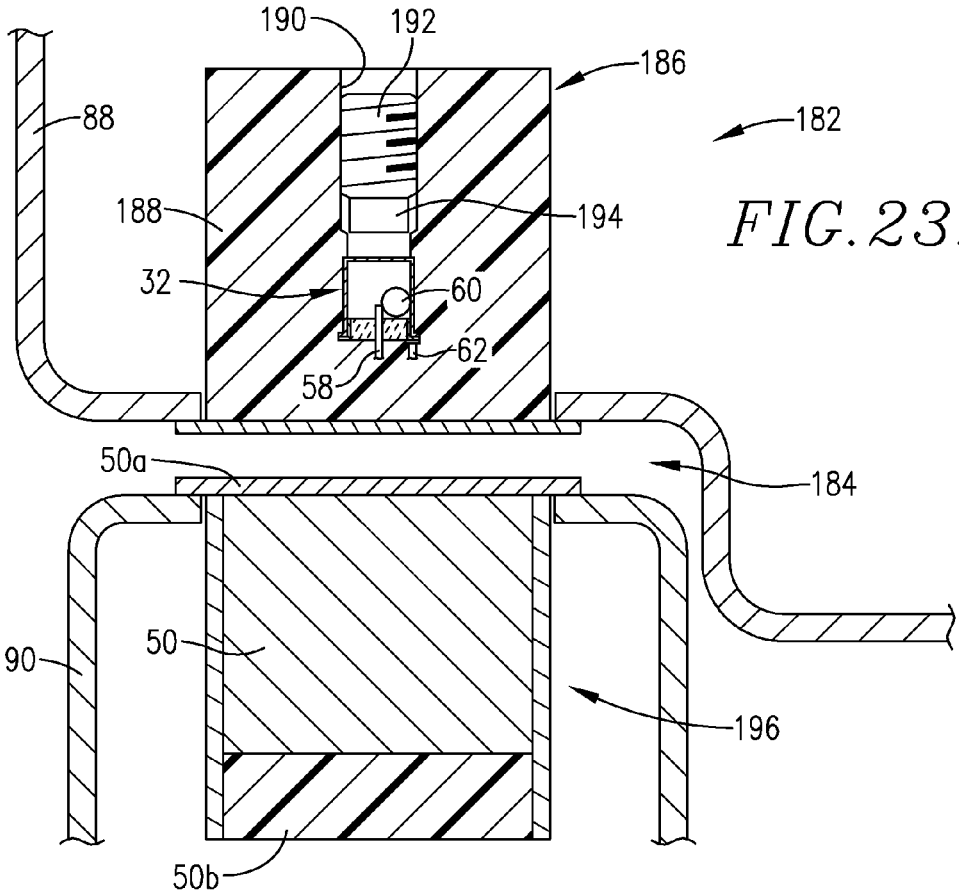
FIG. 23 is a schematic view in vertical section illustrating switch apparatus comprising a magnetic ball switch assembly mounted on a door frame and an operating magnet mounted on the adjacent door, wherein the first or biasing magnet forming a part of the switch assembly is mounted for selective adjustment of the position thereof relative to the switch ball and second or operating magnet on the door.
Figure 24:
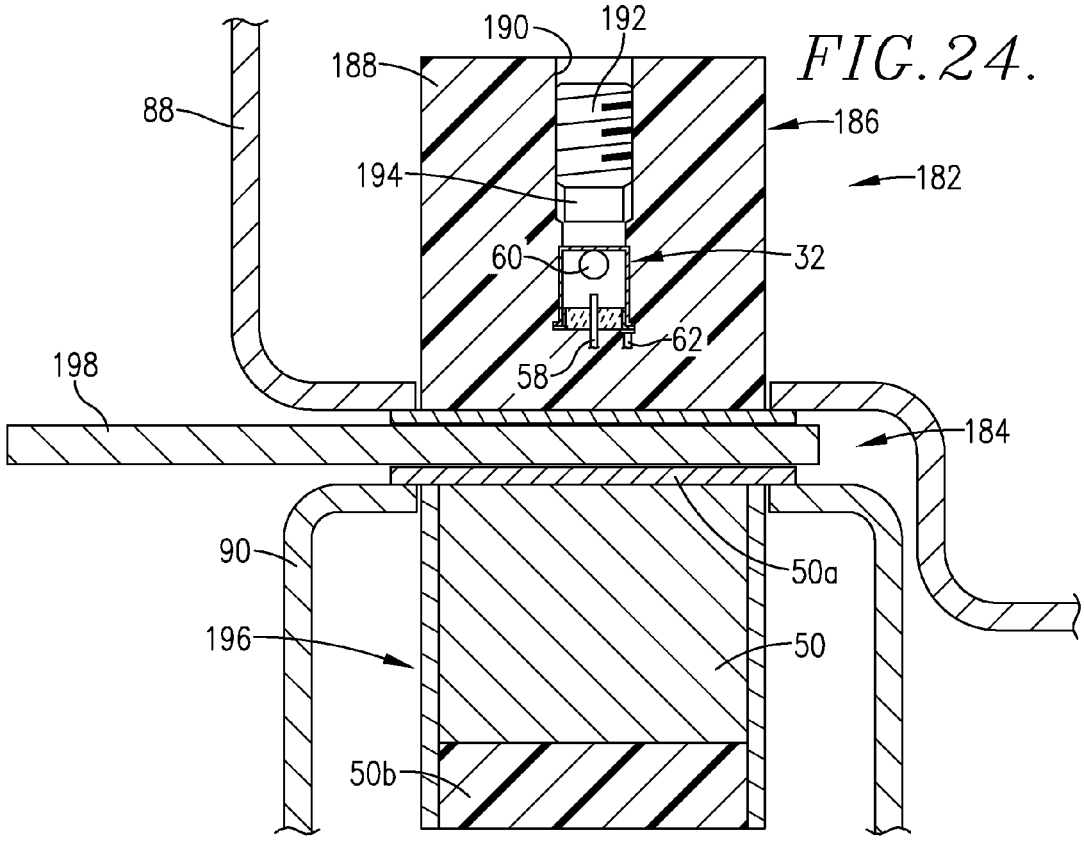
FIG. 24 is a view similar to that of FIG. 23, depicting the operation of the switch apparatus in preventing defeat of the switch apparatus by insertion of a magnet between the door and door frame.
Figure 25:
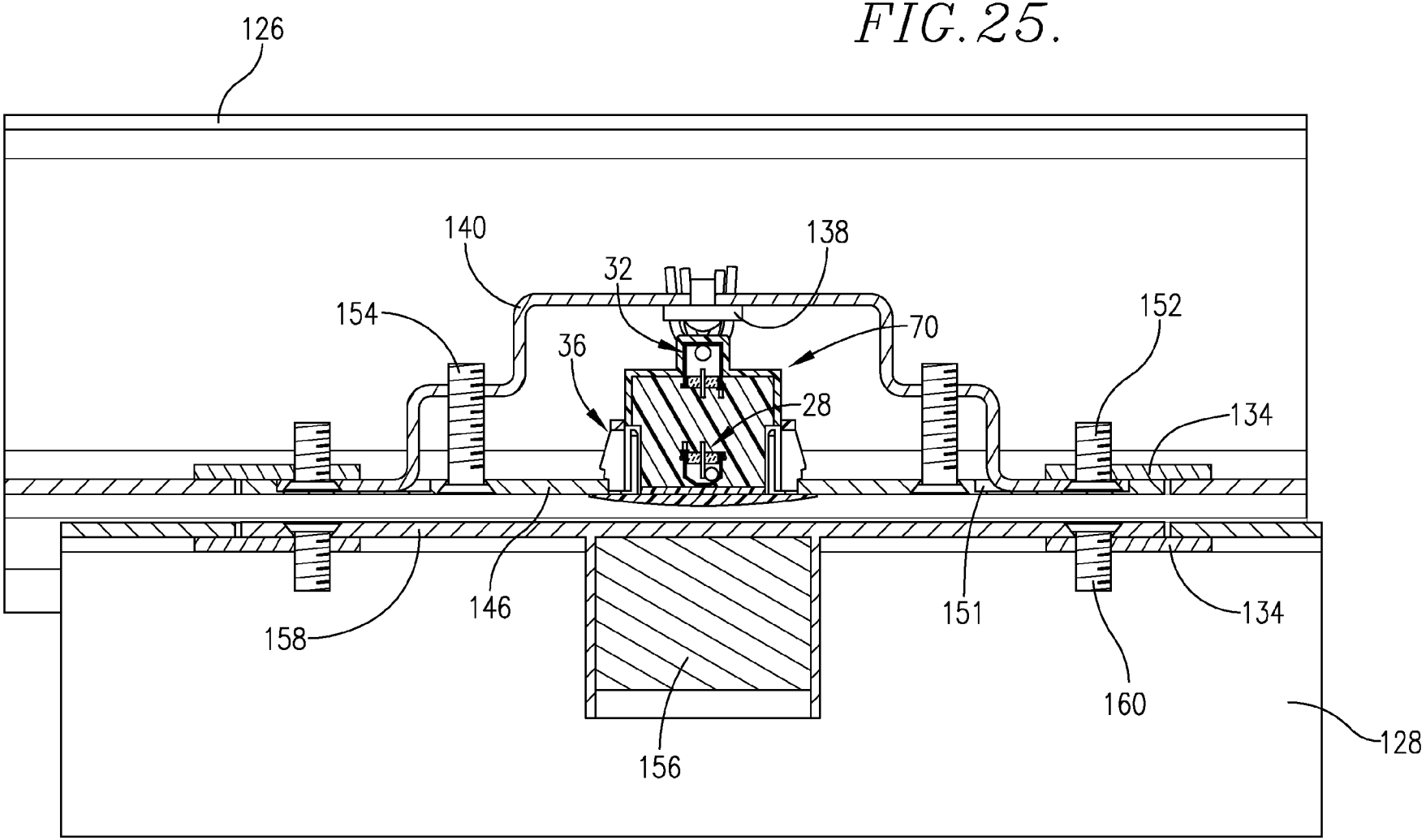
FIG. 25 is an enlarged version of FIG. 16, and showing the internal construction of the switch module.

FIGS. 23-24 depict a switch apparatus 182 cooperatively mounted within door frame 88 and door 90, with a space 184 between the frame and door. The switch apparatus 182 includes a switch assembly 186 mounted with frame 88 and comprising a switch assembly 32, previously described. The assembly 32 is encapsulated within a synthetic resin body 188 equipped with a threaded bore insert 190 located above the assembly 32. A rotatable set screw 192 is located within the insert 190 and carries at the lower end thereof, a first or biasing magnetic component 194. Advantageously, the magnetic component 194 is cylindrical in configuration and is attached by an appropriate glue to adhere to the lower end of screw 192. The overall assembly 182 further includes a second magnetic component 196 which is in the form of a second or operating magnetic component 50, also described above.

The normal operation of switch apparatus 182 is illustrated in FIG. 23. When the door 90 is closed, as illustrated in that figure, the larger second or operating magnetic component 196 serves to magnetically bias ball 62 to the lower position thereof where the ball is in simultaneous contact with the electrodes 58 and 60. When the door 90 is opened, the ball 62 is shifted upwardly under the influence of the first or biasing magnetic component 196 to the second position out of simultaneous contact with the electrodes, thereby initiating an alarm condition.

FIG. 24 illustrates a situation where an intruder may attempt to defeat the switch apparatus 182 by inserting a defeat magnet 198 into the space 184 between the door and door frame. In such an attempt, the intruder would seek to use a defeat magnet of sufficient strength so that, when door 90 is opened, the ball 62 would remain in its lower position, as illustrated in FIG. 23; in essence, the attempt would rely upon the defeat magnet 198 as a substitute for the second or operating magnetic component 196.

Of course, given the small vertical distance between the door and door frame, there is a practical limit upon the strength of any defeat magnet 198. For example, many such spaces have a maximum vertical dimension of about ⅛", which in turn means that the defeat magnet 198 must have a thickness to fit within this dimension.

The switch apparatus 182, by virtue of the screw 192 and attached magnetic component 194, allows the apparatus to be specifically "tuned" to a particular door/door frame assembly (or class thereof) and the dimensions of space 184. That is, the strongest possible defeat magnet 198 is inserted within the space 184 and, if such a defeat magnet allows opening of the door 90 without triggering an alarm, the screw 192 may be rotated to lower the magnetic component 194 toward ball 62 and the second magnetic component 196. Thus, the first magnetic component 194 can be selectively positioned so as to cause ball 62 to magnetically move to the upper or alarm position thereof even when the defeat magnet 198 is positioned and door 90 opened.

We claim:

1. A tamper-resistant switch assembly operable to detect movement of a metal door relative to a metal door frame, said door frame and door each having elongated, rectangular opening formed in opposed surfaces of the door frame and door, said door frame and door openings being in adjacent, opposed relationship when the door is in a closed position within the door frame, there being a pair of opposed, apertured, inwardly extending connection ears at the ends of each of the door frame and door openings, the door frame and door each having a hollow interior space adjacent the corresponding rectangular opening thereof, said switch assembly comprising:

a first movement-sensing switch located within said hollow interior space of said door frame and operable to switch between first and second separate movement-sensing states in response to movement of said door relative to said door frame;

a second tamper-sensing switch assembly also located within said hollow interior space of said door frame and including a switchable component and an actuating component, said switchable component and actuating component being relatively shiftable, said switchable component switchable between first and second tamper-sensing states in response to said relative shifting between the switchable and actuating components, said first movement-sensing switch and the switchable component of said second tamper-sensing switch assembly located within a common housing with said movement-sensing switch proximal to the door frame opening, and with said switchable component located at a position remote from said door frame opening, said common housing secured to a first mounting plate covering said door frame opening, said a first mounting plate having a pair of connection openings;

an elongated bracket located within said hollow interior space of said door frame in opposition to said anti-tamper mounting plate, said bracket having a first pair of outboard connection openings at opposite ends thereof in alignment with the apertures of said door frame connection ears, said first bracket further including a second pair of inboard connection opening inboard of said first pair of outboard connection openings, a first pair of threaded connectors extending through said first outboard pair of connection openings and through the aligned apertures of the door connection ears, in order to secure said first mounting bracket to said door frame;

a second pair of threaded connectors extending through said first mounting plate connection openings and said inboard pair of bracket connection openings, in order to secure the first mounting plate and said supported common housing to said door frame, said actuation component being supported on said bracket and adjacent said switchable component, with said switchable component being separable from said actuating component upon attempted detachment of said bracket from said door frame by removal of said second pair of threaded connectors, said first movement-switch being a magnetically actuatable switch operable to switch between first an second separate movement-sensing states in response to a change in magnetic field conditions adjacent the first movement-sensing switch; and a biasing magnet located within the interior hollow space of said door and supported by an elongated second mounting plate having a pair of connection openings, said second mounting plate covering said door opening, with a third pair of threaded connectors passing through said second mounting plate and into the connection ear openings of the connection ears of said door frame, said biasing magnet operable to maintain said first movement-sensing switch in on of the states thereof when said door is in said closed position thereof within said door frame, said first movement-sensing switch moving to the other switch state thereof when said door is opened, owing to the change of magnetic field conditions adjacent the first movement-sensing switch, whereby any attempted removal of said second threaded fasteners and said common housing will cause said relative shifting of said switchable component and said actuating component so that said switchable component will shift between the tamper-sensing states thereof to detect said attempted removal.

2. The assembly of claim 1, said first movement-sensing switch and said switchable component of said second tamper-sensing switch assembly each being a magnetically operable switch, and with each including a corresponding switch housing, at least one elongated, electrically conductive switch element extending into said switch housing, a shiftable body located within said switch housing and formed of electrically conductive material, and a second electrically conductive switch element, said body shiftable within the switch housing between a first position wherein the body is in electrical contact with both said first and second switch elements, and a second position wherein the body is not in contact with both said first and second switch elements.

3. The assembly of claim 2, said actuating component operable, in response to relative shifting between the switchable component and actuating component, to alter the magnetic field conditions adjacent the switchable component so as to cause a switch between said first and second tamper-sensing states.

4. The assembly of claim 1, said common housing being a module filled with an encapsulant engaging said first switch and switchable component.

5. The assembly of claim 1, said switchable component protruding from the upper surface of said module.

6. The assembly of claim 1, said actuating component being disposed above said switchable component.

7. The switch assemble of claim 1, first mounting plate covering the adjacent ends of said first pair of threaded fasteners.

* * * * *